US010232912B1

(12) United States Patent
Kunstadt

(10) Patent No.: US 10,232,912 B1
(45) Date of Patent: Mar. 19, 2019

(54) RIG FOR SAILBOAT

(71) Applicant: Robert Kunstadt, West Hurley, NY (US)

(72) Inventor: Robert Kunstadt, West Hurley, NY (US)

( * ) Notice: Subject to any disclaimer, the term of this patent is extended or adjusted under 35 U.S.C. 154(b) by 0 days.

(21) Appl. No.: 15/898,610

(22) Filed: Feb. 18, 2018

(51) Int. Cl.

| | |
|---|---|
| ***B63H 15/00*** | (2006.01) |
| ***B63B 15/00*** | (2006.01) |
| ***B63H 9/10*** | (2006.01) |
| ***B63H 9/06*** | (2006.01) |

(52) U.S. Cl.
CPC ..... *B63B 15/0083* (2013.01); *B63H 9/0607* (2013.01); *B63H 9/10* (2013.01); *B63B 2015/0025* (2013.01); *B63H 9/0685* (2013.01)

(58) Field of Classification Search
CPC ..... B63H 9/0607; B63H 9/0614; B63H 2009/0621; B63H 2009/0628; B63H 2009/0635; B63H 9/0685; B63B 2015/0025
See application file for complete search history.

(56) References Cited

U.S. PATENT DOCUMENTS

| | | | | |
|---|---|---|---|---|
| 6,341,571 | B1 | 1/2002 | Russell | |
| 2015/0000578 | A1* | 1/2015 | Strebe | B63B 15/0083 114/39.29 |
| 2018/0208287 | A1* | 7/2018 | Zenoz | B63H 9/10 |

OTHER PUBLICATIONS

American Sail, "Aqua Cat 14 Catamaran", https://www.americansail.com/products/boats/aqua-cat-14-catamaran.

* cited by examiner

*Primary Examiner* — Andrew Polay

(57) ABSTRACT

An improved rig is provided for sailing craft, in which two sails are provided in the general shape of tapered tubes encircling each of two adjacent masts arrayed in an A-frame configuration. In the course of a tack, the sails may be swung pendulum-like either towards or away from the bow (one in each direction). The two sails therefore effectively alternate between serving the role of a jib (with sail-area mainly forward of a mast), and the role of a mainsail (with sail-area mainly aft of a mast). The same set of sails on the same masts may also advantageously be deployed for use in high winds, running downwind, heaving-to, and running before a storm.

6 Claims, 8 Drawing Sheets

RIG FOR SAILBOAT

FIELD OF THE INVENTION

This invention relates to the field of rigs for driving sailing craft by means of wind power.

SUMMARY OF THE INVENTION

An improved rig is provided for sailing craft, in which two sails are provided in the general shape of tapered tubes encircling each of two adjacent masts arrayed in an A-frame configuration. In the course of a tack, the sails may be swung pendulum-like either towards or away from the bow (one in each direction). The two sails therefore effectively alternate between serving the role of a jib (with sail-area mainly forward of a mast), and the role of a mainsail (with sail-area mainly aft of a mast). It is not necessary to tack a jib around a mast. The pair of adjacent masts forms an effective slot for cooperation of the two sails to enhance boatspeed. The same set of sails on the same masts may also advantageously be deployed for use in high winds, running downwind, heaving-to, and running before a storm.

DETAILED DESCRIPTION OF THE INVENTION

Figure 1:
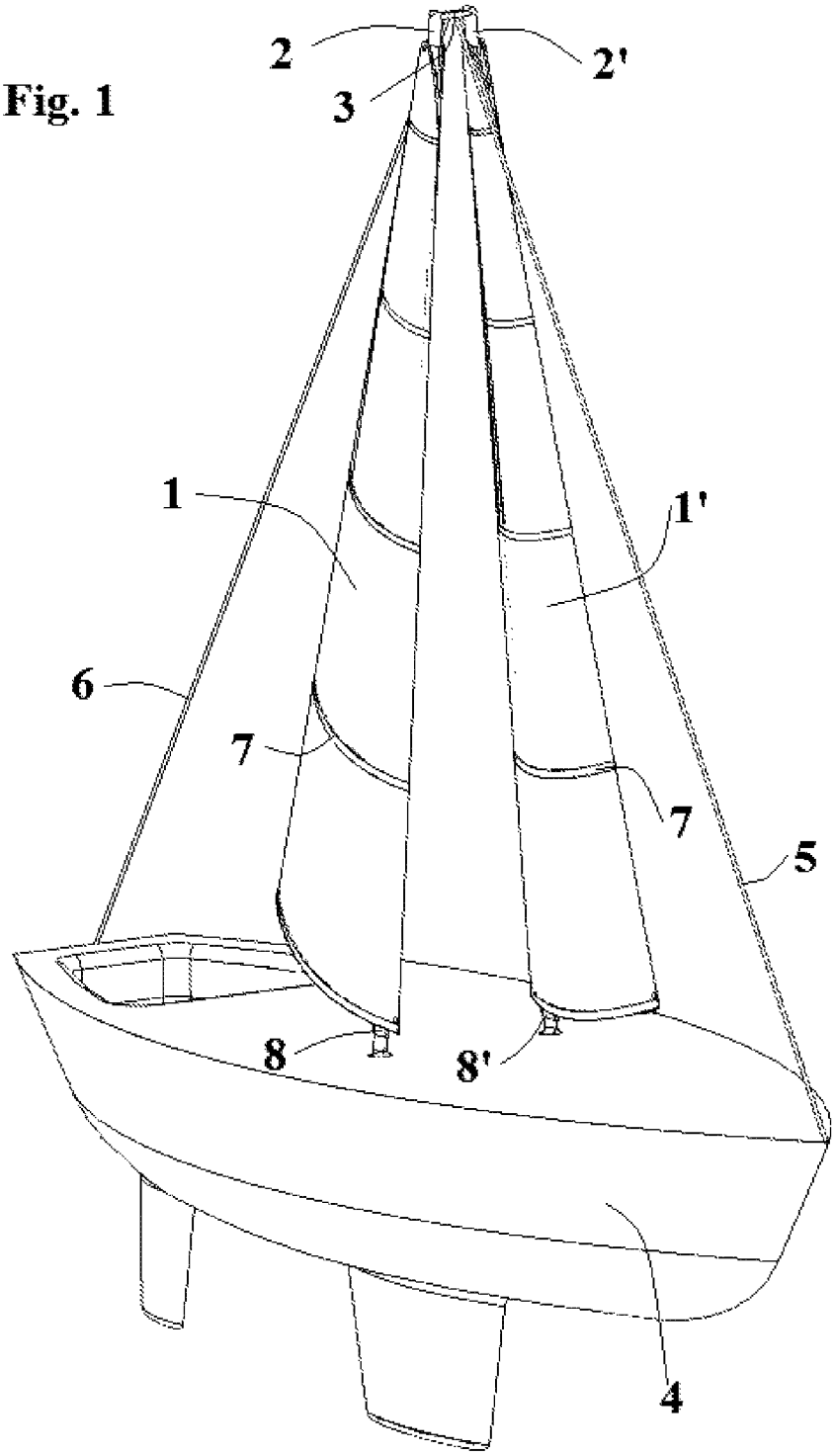
FIG. 1 is a front perspective view of a sailboat with a rig according to an embodiment of the invention, with sails set for beating to windward on starboard tack.

Referring now to FIGS. 1-8, the invention will be described in detail.

Sails 1 and 1' are in the general shape of tapered tubes which encircle each of two masts 2 and 2' arrayed in an A-frame configuration joined at the top by cross-brace 3. Cross-brace 3 may desirably be stayed to hull 4 by forestay 5 and backstay 6. Backstay 6 may optionally be a split backstay.

Sails 1 and 1' may desirably be furnished with battens 7.

Sails 1 and 1' are movable upon each of respective masts 2 and 2' like pendulums. Their tack and clew may be secured to the deck of hull 4 by sheets that can be tensioned and re-positioned appropriately as the wind changes direction and strength.

Sails 1 and 1' alternate between acting as mainsail on port side and jib on starboard side, and vice versa. Hence to tack hull 4, it is not necessary to bring the clew of a foresail around a mast.

The rig of the invention need employ no mainsail boom (which tends to cause injury). Sails 1 and 1' remain under control of their respective sheets at all times, since sheets are not being fully released to tack a jib around a mast; rather, sails 1 and 1' are eased forward or back (which may be accomplished always under a degree of sheet tension).

Masts 2 and 2' being arrayed side-by-side, provide an efficient slot between sails 1 and 1' for promoting speedy upwind travel.

A crew utilizing the rig of the invention may choose to "heave-to" when going upwind, in order to reduce the boat's forward motion. In that case the crew may set the sail on the windward side of hull 4 forward to the bow, instead of drawing it back to the stern. Hence, that windward sail may act to shield the other sail on the downwind side—effectively "backing the jib" to minimize forward motion.

The crew pulls sails 1 and 1' forward and back in order to tack the boat, while simultaneously altering their angle-of-attack to the wind to optimize boatspeed. Techniques that may appropriately be employed for optimizing boatspeed by altering a sail's angle-of-attack to the wind are the subject of a body of nautical lore known to sailors skilled in the art of boat-handling.

In the course of upwind travel, sails 1 and 1' each display a leading edge (luff) to the wind, which may always remain the leading edge. In the course of a tack, sails 1 and 1' may be displaced pendulum-like either towards or away from the bow of hull 4 (one in each direction). Therefore, sails 1 and 1' effectively alternate between serving the role of the jib (with sail-area mainly forward of its mast), and the role of the mainsail (with sail-area mainly aft of its mast).

It may be understood (for purposes of explanation) that according to an implementation of the invention, sails 1 and 1' are prepared by the sailmaker in a general form that may be visualized as tapered bell-bottom pants legs encircling each of two masts; with the two masts corresponding to the two legs of a person wearing such pants. Thus (for the sake of explanation) if you grab the front crease of your pants cuff and pull it forward—then grab the back crease of that same cuff and pull it backwards—that's how each of sails 1 and 1' may be visualized to operate upon respective masts 2 and 2' as the boat tacks through an oncoming wind. When the cuff of the right leg is pulled forward, the cuff of the left leg is pulled back; and vice versa.

But instead of pulling a pants cuff with your hand, sails 1 and 1' may be attached to running rigging at each of their front and back lower corners (tack and clew). Such running rigging may comprise sheets, guys, twings, barberhaulers, vangs tackles and the like; mounted upon blocks, cars, tracks, cleats, belaying pins, cams and the like (being expedients for running rigging now known or later developed).

Sails 1 and 1' may desirably be shaped w/an aerodynamic cross-section (resembling an airplane wing) by means of battens 7 that hold the mid-section of sails 1 and 1' out from their respective masts 2 and 2'; while meeting at the leading and trailing edges (luff and leech). Hence the resulting rig may comprise two aerodynamic "wings" that advantageously form a slot between them. Battens 7 may be fiberglass, wood, aluminum, carbon-fiber or such other suitable semi-rigid materials as may be now known or later developed.

Sails 1 and 1' may be lowered by halyards from the masthead when the crew desires to strike them. Halyards may attach to the tops of masts 2 and 2' by swivel blocks mounted on masthead bails, to permit a desired degree of rotation of sails 1 and 1' about masts 2 and 2'. The capability of striking the sails when underway affords an advantage over a completely-rigid America's-Cup style of wingsail that can only be lowered by a crane on shore.

The crew may alternatively choose to lower sails 1 and 1' only partially, in order to "reef the sails" if the wind is strong. The partially-lowered sailcloth may be secured by reef points.

The sailcloth employed for sails 1 and 1' may be cotton canvas, DACRON, NYLON, SPECTRA, MYLAR, KEVLAR, or such other natural or synthetic sailcloth material(s) as may be now known or later developed.

It may be appreciated that no rigid boom is necessary for deploying sails 1 and 1', hence mitigating risk of injury to crew from being hit by a rigid boom swinging unexpectedly.

But alternatively, a wishbone boom may be employed if desired. A wishbone boom may replace or supplement a lower set of battens 7. Such a wishbone boom, if employed, may attach at its ends to the tack and clew of sails 1 and 1', not to masts 2 and 2'; and could provide more rigidity than ordinarily provided by battens.

Each of sails 1 and 1' may be secured and removed from its respective mast 2 and 2' by means of a VELCRO hook-and-loop strip that holds it together at or near its trailing edge (leech). Sails 1 and 1' may be hoisted and secured to the top of their respective masts 2 and 2' by halyards. Upon releasing the halyards, sails 1 and 1' fall to the deck of hull 4; but they still encircle their respective masts 2 and 2' until the crew chooses an appropriate time to unfasten the VELCRO strips in order to break the circle and remove sails 1 and 1' to stow in their sailbags. Hence both sails 1 and 1' are restrained by their respective masts 2 and 2' from being inopportunely blown or washed overboard (as may happen when a prior-art headsail is lowered in strong wind or high seas; especially one on a luff-track).

In case more fastening strength is desired than a VELCRO strip may provide, other fasteners such as zippers, press-to-close snaps, hooks, laces, lashings, magnetic snaps, buttons, toggles, buckles, bolts and the like (now known or later developed) may be employed; either in combination as reinforcement; or separately.

Figure 2:
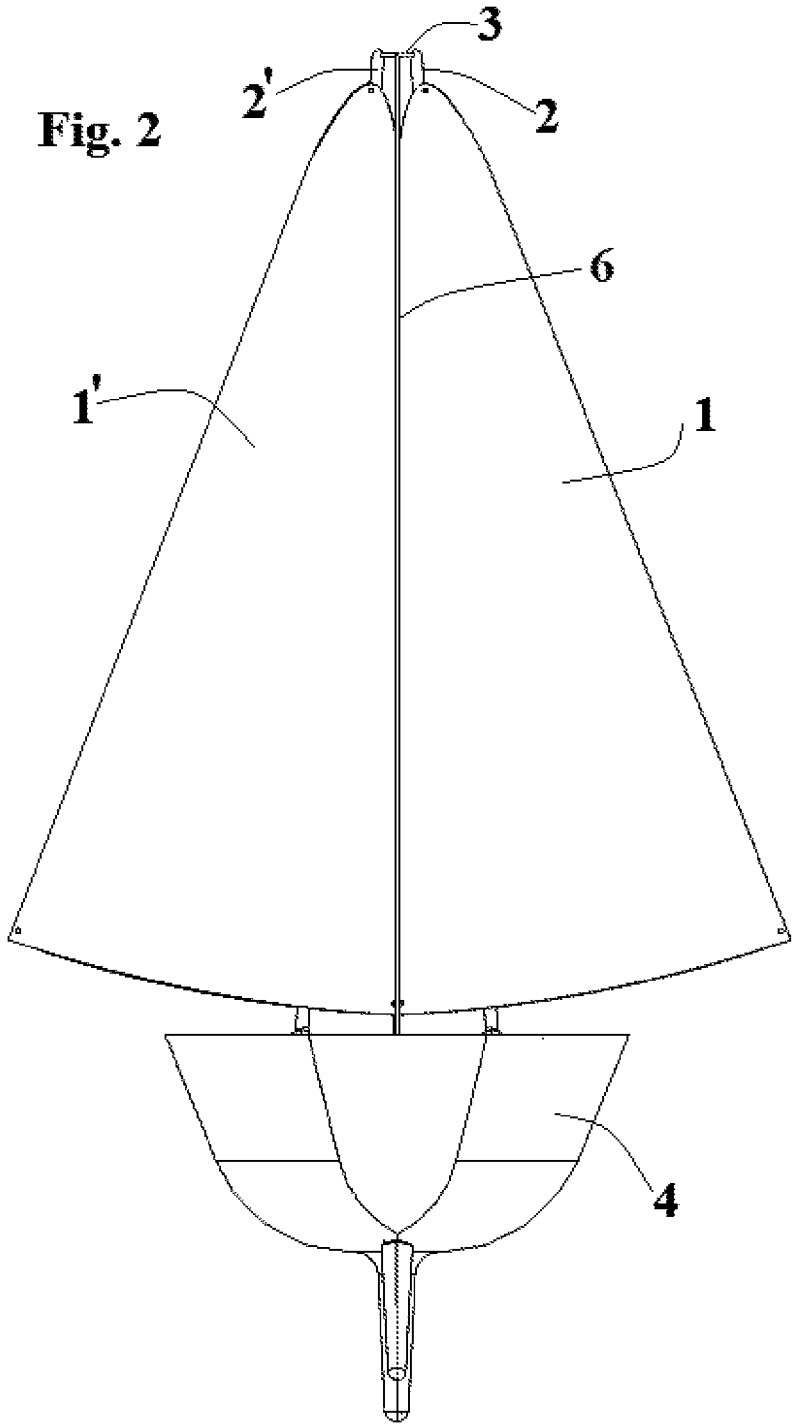
FIG. 2 is rear elevation view of a sailboat with a rig according to an embodiment of the invention, with sails set for running before the wind.

Referring now to FIG. 2, to sail downwind the crew may wing sails 1 and 1' out to opposite sides of hull 4. Whisker poles may be employed. The inboard edges of sails 1 and 1' may be brought together (or overlapped) so there is little or no gap between them. Alternatively, the crew may prefer to leave a gap between sails, if the wind is strong. Such a gap would tend to spill wind, so the boat would be less likely to become overpowered.

FIG. 2 illustrates an embodiment without battens or wishbone booms; but in case battens and/or wishbone booms are employed, sails 1 and 1' so-equipped could be deployed in the same winged-out setting illustrated in FIG. 2.

Figure 3:
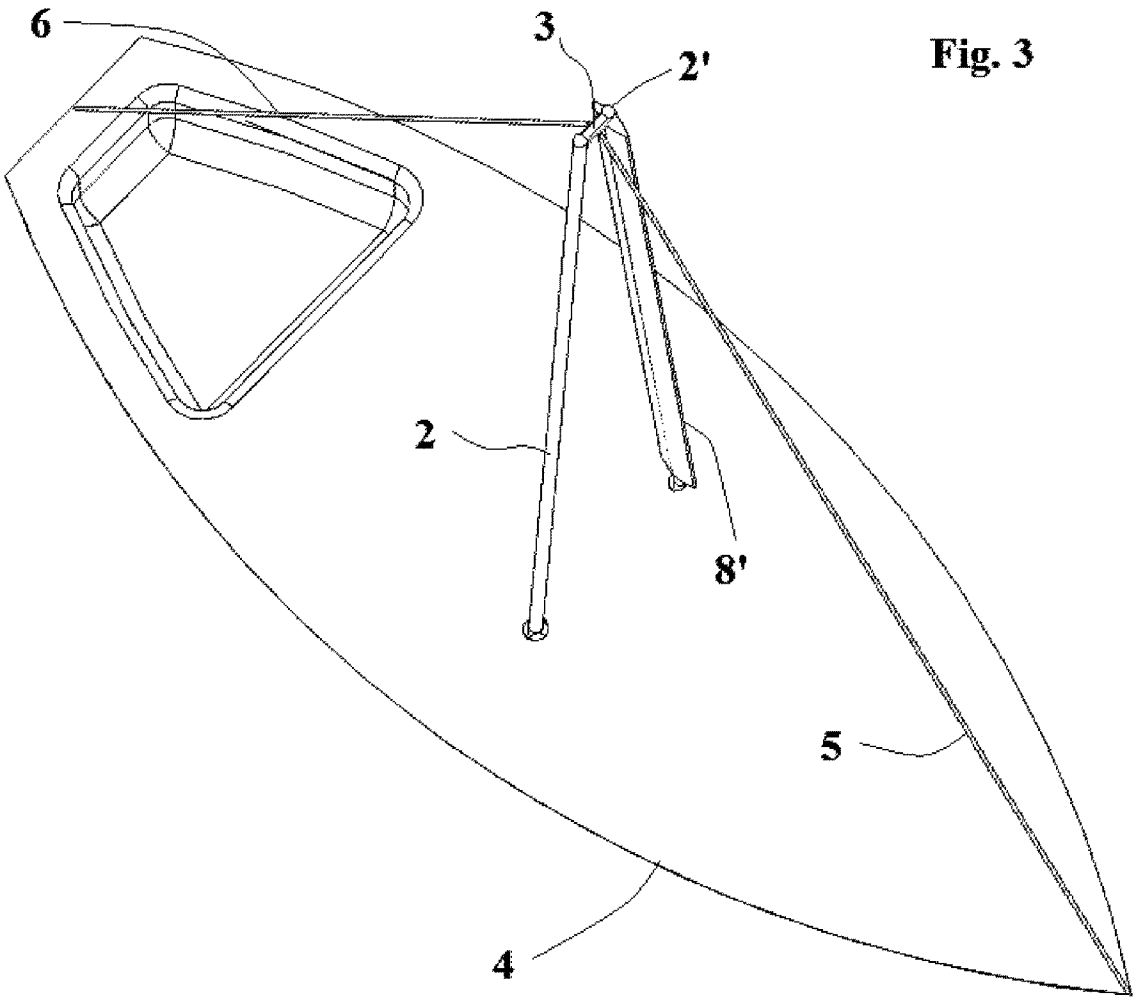
FIG. 3 is a top perspective view of a sailboat with a rig illustrating alternate embodiments of the invention, shown without sails for clarity.

Referring now to FIG. 3, masts 2 and 2' may be of uniform round cross-section, or they may desirably be tapered towards the top. They may be of aluminum, wood, fiberglass, carbon fiber, or other suitable structural material(s) now known or later developed.

Masts 2 and 2' may optionally be provided with sleeves 8 and 8', which may be generally elliptical in cross-section. (Note that FIG. 3 shows only sleeve 8' for mast 2', in order to illustrate the difference between a mast with and without a sleeve; the other sleeve 8 for mast 2 may be seen in FIG. 1 and in FIG. 4).

Sleeves 8 and 8' may rotate about their respective masts 2 and 2' as the angle of hull 4 to the wind changes. Sleeves 8 and 8' may be hollow carbon-fiber shells for light weight.

Figure 4:
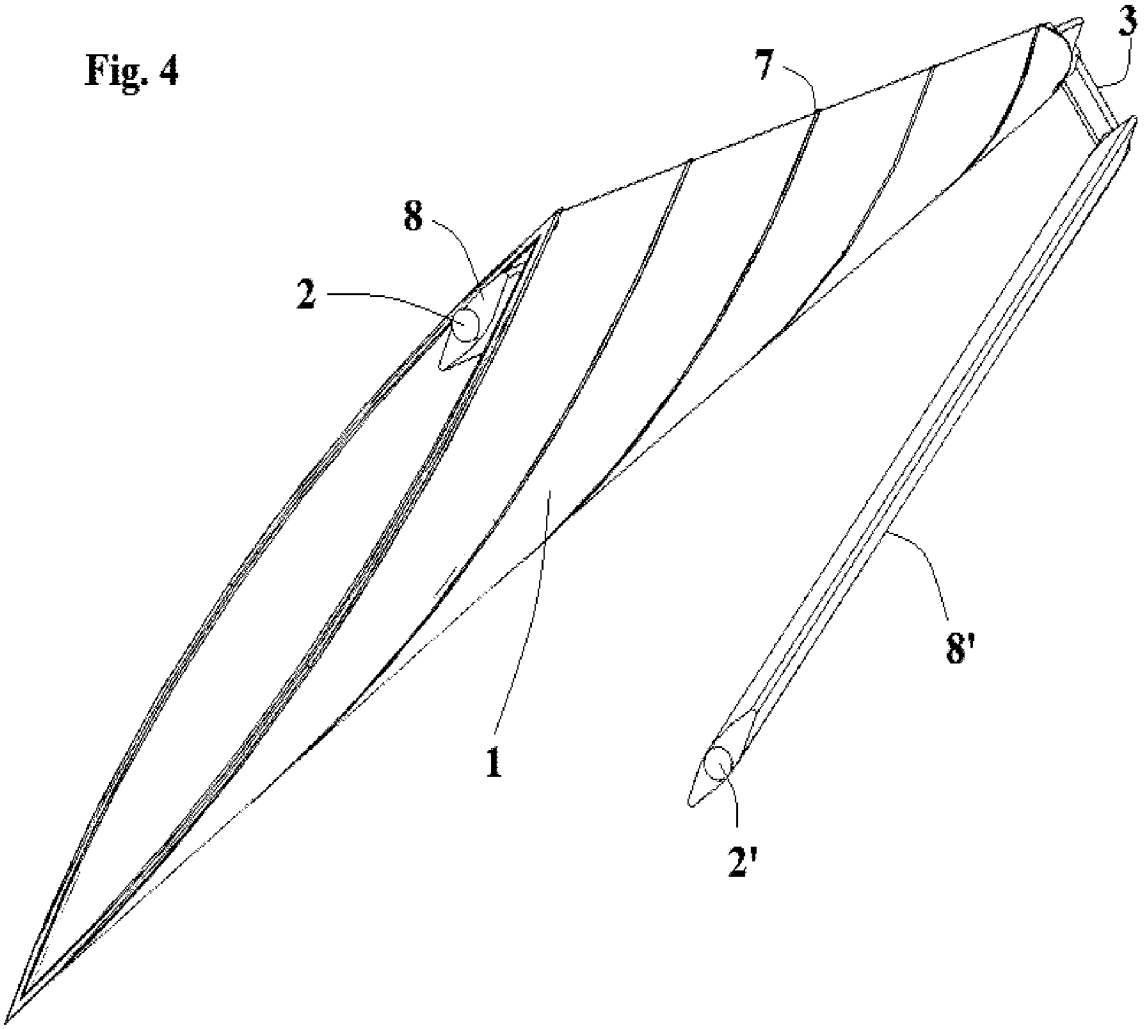
FIG. 4 is a bottom perspective view of a rig according to an embodiment of the invention, shown with one sail omitted for clarity.

Referring now to FIG. 4, sleeves 8 and 8' serve to urge the edges of sails 1 and 1' into an aerodynamic elliptical cross-section (instead of otherwise assuming the round cross-section of masts 2 and 2'). Utilizing elliptical sleeves 8 and 8' may be especially desirable in case it is preferred that sails 1 and 1' be made without battens (or with only a limited number of battens). (Note that sail 1' is omitted from FIG. 4, in order to depict the full length of sleeve 8').

Sleeves 8 and 8' may encircle their respective masts 2 and 2' and remain in contact with them (while rotating about them); or each may optionally be made to split vertically into portions that separate from each other. In that case, the top end of each split-sleeve may be attached to and pivot from a rotating bearing around the top of its mast, effectively joining the top ends rotatably together; while the lower end of each split-sleeve may swing away from its mast and be secured to the respective tack or clew of its sail. Hence each split-sleeve's lower end may swing pendulum-like toward and away from its mast—together with the leading or trailing edge of its sail—as the sail is trimmed. In that manner, both the leading edge and the trailing edge of a sail (luff and leech) may always be urged into an elliptical shape, by each being maintained in contact with its respective split-sleeve.

Figure 5:
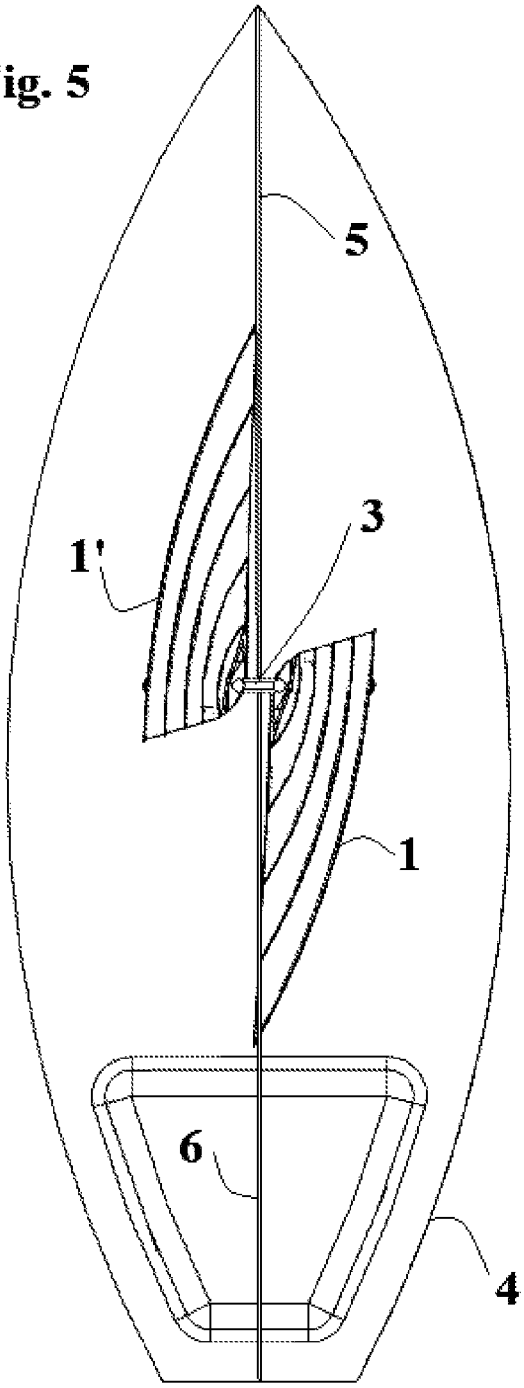
FIG. 5 is a top plan view of the sailboat of FIG. 1, with sails set for beating to windward on starboard tack.

Referring now to FIG. 5, it may be further appreciated how sails 1 and 1' may be set for beating into the wind on starboard tack (as was also shown in FIG. 1).

Figure 6:
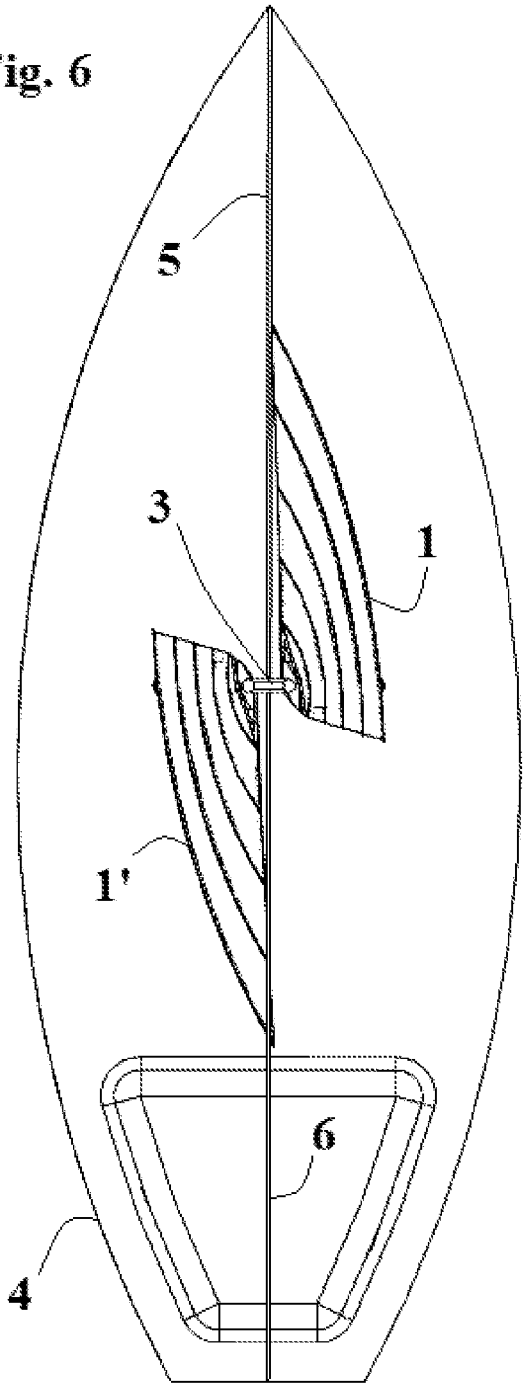
FIG. 6 is a top plan view of a sailboat with a rig according to an embodiment of the invention, with sails set for beating to windward on port tack.

To change course and beat into the wind on port tack, sail 1 would be swung forward and rotated counter-clockwise; and sail 1' would be swung aft and rotated counter-clockwise. The resulting set of the sails on port tack is shown in FIG. 6. It will be appreciated that FIG. 6 is essentially the mirror-image of FIG. 5.

Figure 7:
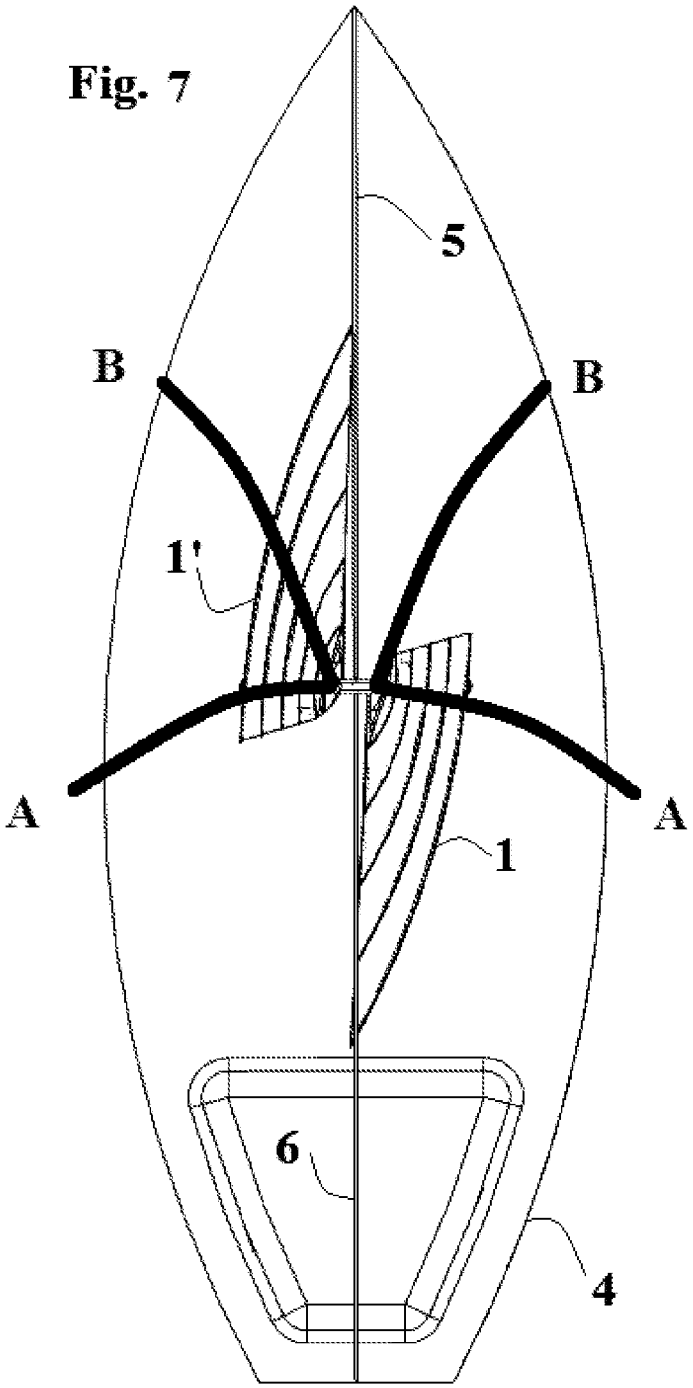
FIG. 7 is a top plan view of a sailboat with a rig according to an embodiment of the invention, illustrating alternative trims of the sails for running before the wind.

Referring now to FIG. 7, sails 1 and 1' when in Position "A" are trimmed to wing out (as shown in FIG. 2 and described above in connection with running downwind). But if the wind is very strong from astern, the crew may prefer to bring both sails 1 and 1' forward towards the bow to Position "B", to present less surface area to the wind and effectively "run before the storm", while helping to keep the bow of hull 4 always pointed downwind. In that case, the leading edge (luff) of each of sails 1 and 1' will be near its respective mast 2 and 2', while the trailing edge (leech) will be positioned between its mast and the bow of hull 4. Hence sails 1 and 1' cooperate to present a wedge pointing into the wind that is coming from astern. If the transom of hull 4 wanders to the right, which may result from a wave passing under the stern from the port quarter, then more of sail 1' will be exposed to the wind than sail 1, so the bow of hull 4 will tend to be pushed to the right by a self-steering action of the wind; and vice versa.

Hence the beneficial wedge formed by sails 1 and 1' set in Position B during a storm, may tend to keep hull 4 running squarely before the wind at all times—rather than unwantedly coming broadside to the wind. Broadside to the wind when running before a storm is generally considered an unfavorable aspect: a boat that comes broadside to the wind in a storm may take waves over the side and founder.

In order to move sail 1 (or sail 1') from its close-hauled setting to Position B, it is not necessary to rotate it through Position A (although that is possible). Instead, sail 1 may be swung directly forward to Position B in a pendulum motion, pivoting about its halyard suspended from the top of mast 2 (or sleeve 8, as the case may be). Swinging the sails pendulum-like—rather than rotating them through a large angle—may facilitate rapid changes of course such as from upwind to downwind and vice versa.

Each of the tack and/or clew of each of sails 1 and 1' may optionally be under control of more than a single running rope, so that the appropriately-led rope may be tensioned while the new lazy rope is eased. By rigging appropriately pre-positioned sets of working ropes and lazy ropes, a sail may (e.g.) be swung and rotated to a new angle simultaneously. Such a rigging configuration may be especially desirable in the case of a large boat with tall masts and substantial sail area. In a small boat in light wind, it may suffice to redirect a rope by hand to a new belaying point. Other expedients are possible and will be apparent to a skilled crew; e.g., employing a barberhauler or twing to rotate a sail under sheet tension.

Utilizing the rig of the invention, such re-positioning of the sails may be accomplished under control of tensioned ropes at all times, so that a sail is not let loose to flog unrestrained. In contrast, in order to tack or gybe a prior-art jib around a prior-art mast it is necessary to throw off the sheet—so that the jib and the sheet flog uncontrollably until the jib has rounded the mast sufficiently that the new sheet may be trimmed. Similarly undesirably, a prior-art mainsail on a prior-art boom may swing across a cockpit occupied by crew in the course of a tack or gybe; unrestrained by mainsheet tension and presenting a hazard to the crew.

In some cases it may be preferred to move sail 1 (or sail 1') from its close-hauled setting to Position A, by first swinging it to Position B as an intermediate position; then subsequently rotating it back to Position A.

The swinging motion enabled by the rig of the invention may be executed by the crew at a moment when the turning boat is at its most favorable aspect to the wind, in order to facilitate such motion without undue stress on the sails (neither tending to flog them, nor to catch them needlessly broadside to the wind). This may prove especially desirable in difficult sailing conditions of heavy wind and sea.

Sails set in Positions A or B may be reefed, as described above, to reduce sail area exposed to storm forces.

Sails set in Position A or B need not be set square to the stern of hull 4; they may be rotated as appropriate in case a course is desired with wind coming from over a stern quarter.

The exact set of the sails may be trimmed by the skilled crew in response to changes in angle and strength of wind (on any point of sail such as close-hauled, beam reach, broad reach, or downwind). Sails 1 and 1' may be swung pendulum-like on their respective masts 2 and 2'; rotated clockwise and/or counterclockwise about their respective masts 2 and 2'; and/or brought towards or away from each other; all as appropriate for changing conditions of wind and sea. The rig of the invention thereby affords new possibilities for a range of sail-handling techniques not heretofore available from prior-art rigs.

For example, if the crew were concerned about gusty wind conditions, they might not wish to trim the leeward sail all the way forward on its mast. Keeping the leeward sail somewhat back of its maximum forward excursion could help to keep the rig balanced and may have the effect of sailing with a smaller jib. The crew equipped with the rig of the invention may not need to make a sail change, or to reef the leeward sail, to accomplish that.

It may not be necessary to trim both sails 1 and 1' to the same aspect, when beating upwind. Although some aerodynamic efficiency and hence momentary boatspeed may thereby be sacrificed, intentionally trimming sails 1 and 1' to slightly different aspects may permit the boat to drive forward through oncoming seas even in fluky conditions when wind direction shifts continually and unpredictably; and without undue attention from the driver at the helm (for example, in case of singlehanded sailing). In that case, at least one of sails 1 and 1' may be drawing effectively so as to prevent a dead stall. Both sails 1 and 1' might be drawn backwards on their respective masts 2 and 2' so as to act effectively as mainsails, with each being trimmed to present a slightly different aspect to the wind. One sail may be advanced any desired distance forward of the other.

Figure 8:
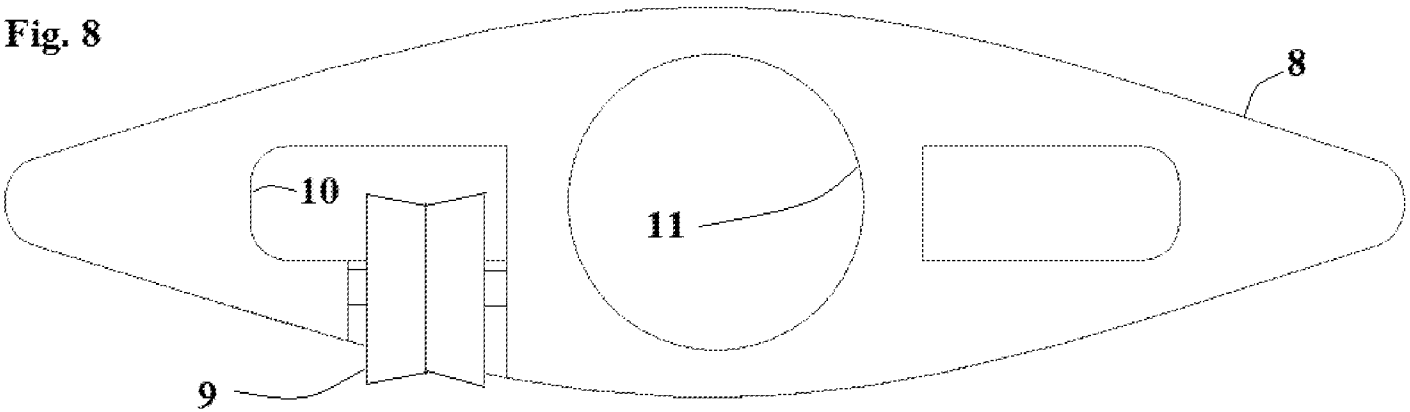
FIG. 8 is a top plan view of a mast sleeve according to an embodiment of the invention.

Referring now to FIG. 8, it may be appreciated that according to an embodiment of the invention sleeve 8 may be provided with hollow internal regions. Sheave 9 may be provided at a suitable location near the top of sleeve 8 in order to lead a halyard down within hollow channel 10. Sleeve 8 may rotate about a hollow region forming circular mast-receiving surface 11. The extent of rotation may exceed even 360 degrees since sheave 9 is secured to the top of sleeve 8 rather than to the masthead; and the halyard tail is correspondingly secured to the bottom of sleeve 8 (rather than to non-rotatable mast 2, or to hull 4). Halyard tails may be protected from chafe by running in channel 10 provided internal to sleeve 8; or alternatively, in a recess provided upon an external surface of sleeve 8.

The configuration illustrated in FIG. 8 with respect to sleeve 8, similarly may apply in the case of corresponding sleeve 8'. Hence sleeves, sails and halyards may rotate freely as a unit about their respective masts 2 and 2'. Sleeves 8 and 8' may rest upon thrust-bearings positioned upon the deck of hull 4; upon thrust-bearings encircling masts 2 and 2' above deck level; and/or be suspended from thrust-bearings secured near the tops of masts 2 and 2'.

While the drawing figures illustrate hull 4 as monohull having fixed-ballast keel with spade rudder, the rig of the invention may be employed upon a catamaran; trimaran; centerboard-dinghy; centerboard-keelboat; swing-keelboat; canting-keelboat; water-ballasted craft; scow; planing-dinghy; hydrofoiling craft; or such other suitable hull forms as may be now known or later developed.

The invention is not limited to the exact embodiments and uses shown and described, and may be realized and implemented in such other ways as will be apparent to the skilled artisan utilizing the teachings of the invention.

The invention claimed is:

1. An A-frame rig for a sailing craft comprising a first strut and a second strut, each of said struts being circular in cross-section; said first strut being provided with a first rotatable sleeve and said second strut being provided with a second rotatable sleeve; each of said rotatable sleeves being substantially elliptical in cross-section; a first receiving point for a first halyard and a second receiving point for a second halyard; said receiving point for said first halyard being upon said first sleeve and said second receiving point for said second halyard being upon said second sleeve; each of said struts being provided with a tubular sail controllably disposed both to swing and to rotate thereon.

2. An A-frame rig for a sailing craft comprising a first strut and a second strut; a first tubular sail for removably encircling said first strut; and a second tubular sail for removably encircling said second strut; each of said tubular sails being hoisted from its respective strut and being controllably disposed both to swing and to rotate thereon.

3. An A-frame rig for a sailing craft according to claim 2, said rig being disposed upon a craft; said first strut having a first mounting point upon said craft and said second strut having a second mounting point upon said craft; said first mounting point and said second mounting point each being spaced from the centerline of said craft.

4. An A-frame rig for a sailing craft according to claim 3, each of said first and second tubular sails being provided with shaping means for urging it into an aerodynamic cross-section.

5. An A-frame rig for a sailing craft according to claim 4, said shaping means comprising battens and said aerodynamic cross-section being tapered towards leading and trailing edges of said sails.

6. An A-frame rig for a sailing craft according to claim 2, said first and second tubular sails each being tapered from foot to head; said first and second tubular sails each being provided with battens and shaped thereby into an aerodynamic cross-section.

* * * * *